US011104013B2

(12) United States Patent
Scimone et al.

(10) Patent No.: US 11,104,013 B2
(45) Date of Patent: Aug. 31, 2021

(54) CUTTING DEVICE

(71) Applicant: Slice, Inc., San Jose, CA (US)

(72) Inventors: Thomas Scimone, Campbell, CA (US); Scot Herbst, Santa Cruz, CA (US); Robert Joseph Gallegos, Fremont, CA (US)

(73) Assignee: Slice, Inc., San Jose, CA (US)

( * ) Notice: Subject to any disclaimer, the term of this patent is extended or adjusted under 35 U.S.C. 154(b) by 62 days.

(21) Appl. No.: 16/274,739

(22) Filed: Feb. 13, 2019

(65) Prior Publication Data

US 2020/0215704 A1 Jul. 9, 2020

Related U.S. Application Data

(63) Continuation of application No. 16/239,058, filed on Jan. 3, 2019, now Pat. No. 10,889,013.

(51) Int. Cl.
*B26B 5/00* (2006.01)
*B25F 1/04* (2006.01)

(52) U.S. Cl.
CPC ..... *B26B 5/00* (2013.01); *B25F 1/04* (2013.01); *B26B 5/003* (2013.01)

(58) Field of Classification Search
CPC .... B26B 3/00; B26B 3/06; B26B 5/00; B26B 5/006; B26B 5/007; B25F 1/04
USPC ..... 30/329, 332, 334, 337–340, 342
See application file for complete search history.

(56) References Cited

U.S. PATENT DOCUMENTS 1,577,880 A * 3/1926 Stuart ..... A61B 17/3213 30/340
2,439,071 A * 4/1948 Basham ..... B25G 3/18 30/342
2,569,286 A * 9/1951 Bunker ..... B26B 1/00 30/329
2,695,450 A * 11/1954 Platts ..... B26B 3/06 30/342
2,904,373 A * 9/1959 Dowdy et al. ..... B25G 1/00 30/342
2,960,769 A * 11/1960 Matwijcow ..... A61B 17/3213 30/340
3,080,653 A * 3/1963 Dolin ..... B26B 5/00 30/329
4,817,284 A * 4/1989 Sacherman ..... B26B 5/00 30/329
5,175,934 A * 1/1993 Chao ..... B26B 5/00 30/329

(Continued)

*Primary Examiner* — Jason Daniel Prone
(74) *Attorney, Agent, or Firm* — Ellenoff Grossman & Schole LLP; James M. Smedley; Alex Korona

(57) ABSTRACT

The apparatus has a blade retaining member that is elongated in a longitudinal direction, a recess disposed in the blade retaining member, the recess having a first portion extending in the longitudinal direction and a second portion extending in a radial direction, a protruding portion that extends from the blade retaining member in the longitudinal direction, and a protrusion disposed on the protruding portion. The recess is a first attachment portion configured to removably attach the removably-attachable blade cartridge to a first cutting device. The protrusion is a second attachment portion configured to removably attach the removably-attachable blade cartridge to a second cutting device.

10 Claims, 10 Drawing Sheets

(56) References Cited

U.S. PATENT DOCUMENTS 5,933,918 A * 8/1999 Wallays ..... A47J 45/071 30/340
6,151,786 A * 11/2000 Hellstern ..... B26B 9/00 30/346
6,408,525 B1 * 6/2002 Marttiini ..... B26B 3/00 30/340
6,675,483 B2 * 1/2004 Bond ..... A47G 21/02 30/340
6,715,211 B1 * 4/2004 Chi ..... B23D 51/10 30/329
7,475,480 B2 * 1/2009 Votolato ..... B26B 5/00 30/337
7,647,704 B2 * 1/2010 Petersen ..... A61B 17/3217 30/329
7,866,050 B2 * 1/2011 Yu ..... B26B 1/10 30/342
7,937,840 B2 * 5/2011 Chen ..... B26B 5/00 30/337
8,056,242 B2 * 11/2011 Chen ..... B26B 5/00 30/342
8,099,868 B1 * 1/2012 Votolato ..... B26B 5/00 30/337
8,549,754 B2 * 10/2013 Bung ..... B26B 5/00 30/340
D779,297 S * 2/2017 Scimone ..... D8/20
10,086,521 B2 * 10/2018 Huang ..... B26B 5/00
10,315,317 B2 * 6/2019 Votolato ..... B26B 5/00
10,315,325 B2 * 6/2019 Votolato ..... B26B 5/00
10,442,093 B2 * 10/2019 Jacobs ..... B26B 5/00
10,889,013 B2 * 1/2021 Scimone ..... B26B 5/005
2002/0066189 A1 * 6/2002 Parrish ..... B26B 3/00 30/340
2003/0079353 A1 * 5/2003 Lovell ..... B23D 51/10 30/337
2003/0188434 A1 * 10/2003 Chiu ..... B25B 15/02 30/329
2010/0263219 A1 * 10/2010 Kempker ..... B26B 5/00 30/337
2017/0120469 A1 * 5/2017 Votolato ..... B26B 5/00
2018/0001489 A1 * 1/2018 Scimone ..... B26B 5/00
2019/0358840 A1 * 11/2019 Reyes ..... B26B 5/00
2020/0215703 A1 * 7/2020 Scimone ..... B26B 5/003

* cited by examiner

CUTTING DEVICE

This application claims the benefit of U.S. Nonprovisional patent application Ser. No. 16/239,058 filed on Jan. 3, 2019, which is hereby incorporated by reference in its entirety.

TECHNICAL FIELD

The present disclosure generally relates to a cutting device, and more particularly to a cutting device having a retractable blade.

BACKGROUND

Precision cutting devices are used in many applications and industries. Conventional precision cutting devices typically involve devices that have a constantly exposed blade or that have caps or covers that may be easily misplaced or lost. Precision cutting devices also typically include relatively sharp blades that may pose the potential for accidental cutting of objects, users, or others.

Accordingly, conventional precision cutting devices are often carried, stored, and left unattended with a relatively sharp, exposed blade that may pose the potential for accidents to users and others, as well as accidental damage to property. Further, precision blades themselves, which may be relatively susceptible to damage, may be accidentally deformed or broken based on being in a continuously exposed state. Accordingly, a need for a way for efficiently avoiding inadvertent cutting of objects and users and avoiding loss of easily misplaced caps and covers exists in the art. Also, a need for efficiently replacing and reusing blade cartridges between multiple cutting devices exists in the art.

The exemplary disclosed cutting device and method of the present disclosure is directed to overcoming one or more of the shortcomings set forth above and/or other deficiencies in existing technology.

SUMMARY OF THE DISCLOSURE

In one exemplary aspect, the present disclosure is directed to a cutting device. The cutting device includes a housing assembly, a cutting assembly that is movably disposed in the housing assembly, the cutting assembly being movable in a first axis, between a retracted position and an extended position, and an urging member disposed between the housing assembly and the cutting assembly. The cutting assembly also includes a cutting member. The cutting assembly further includes an end assembly, which is actuatable in the first axis, and a movable member that is movable relative to the cutting assembly. When the end assembly is actuated, the urging member biases the cutting assembly in the first axis toward the retracted position. When the end assembly is actuated, the end assembly moves the movable member in a second axis that is different from the first axis.

In another aspect, the present disclosure is directed to a method. The method includes disposing a cutting assembly in a housing assembly, removably attaching a cutting member to the cutting assembly, moving the cutting assembly in the housing assembly in a first direction from a retracted position to an extended position, and moving the cutting assembly in the housing assembly in a second direction from the extended position to the retracted position. The method also includes biasing the cutting assembly in the second direction with an urging force, actuating the cutting assembly in the first direction with an actuating force that is greater than the urging force, and moving a movable member of the cutting assembly in a third direction that is different from the first and second directions.

DETAILED DESCRIPTION AND INDUSTRIAL APPLICABILITY

Figure 1:
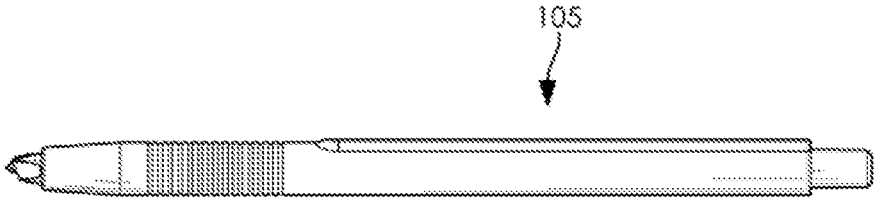
FIG. 1 is a side view of an exemplary cutting device in accordance with an embodiment of the present invention.
Figure 2:
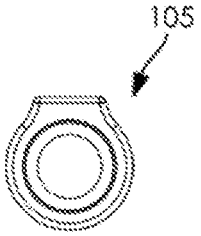
FIG. 2 is a rear view of an exemplary cutting device in accordance with an embodiment of the present invention.
Figure 3:
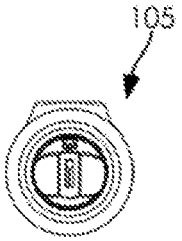
FIG. 3 is a front view of an exemplary cutting device in accordance with an embodiment of the present invention.

FIGS. 1-3 illustrate an exemplary cutting device 105. The exemplary cutting device disclosed herein may be any suitable device for cutting material such as, for example, a cutting device used for precision cutting of material. For example, cutting device 105 may be used for precisely cutting material for use in technical applications such as engineering and manufacturing, artistic or graphic design uses, or any other suitable activity involving precise cutting of objects or materials.

Figure 4:
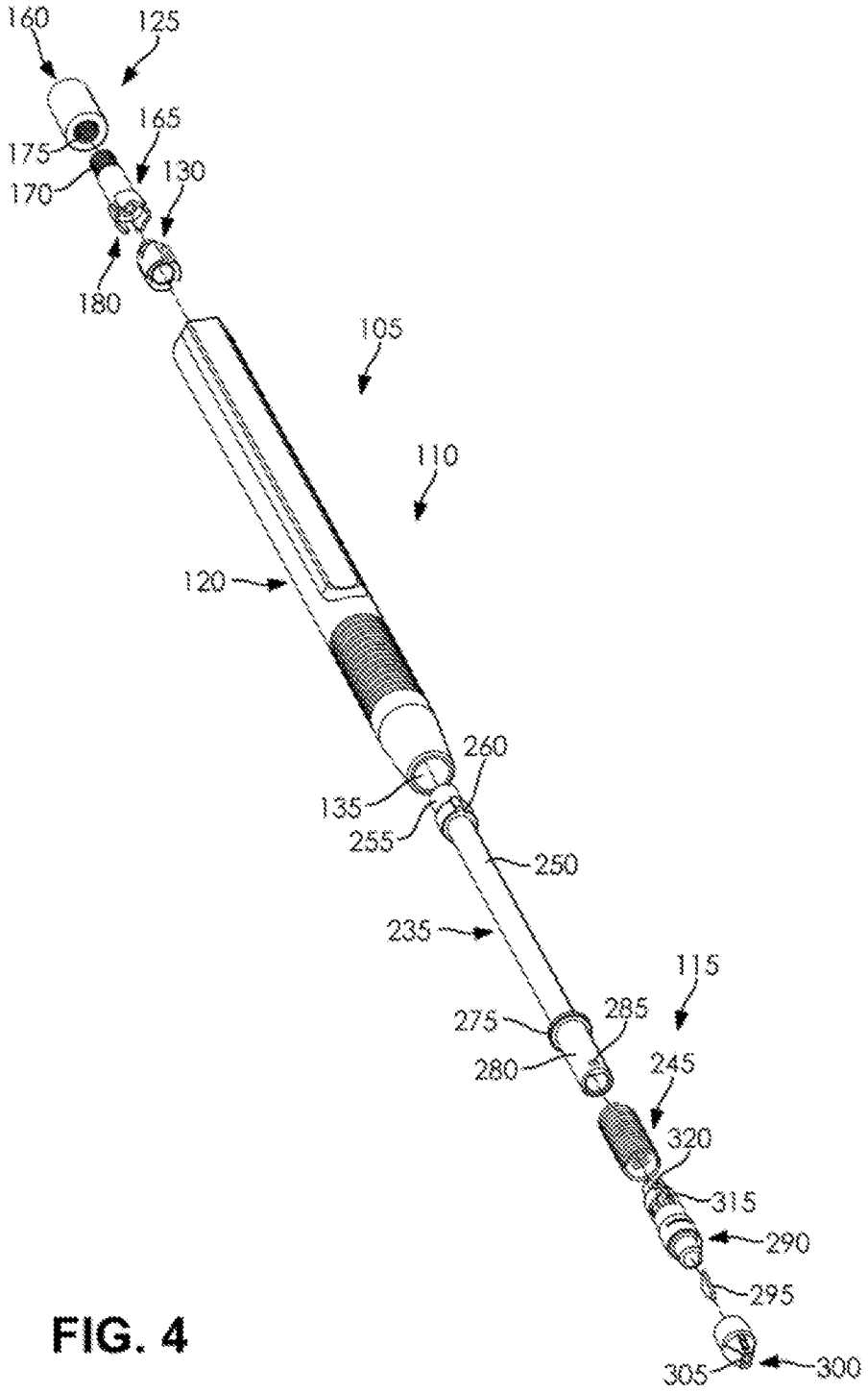
FIG. 4 is a perspective view of an exemplary cutting device in accordance with an embodiment of the present invention.

As illustrated in FIG. 4, cutting device 105 may include a housing assembly 110 and a cutting assembly 115. Cutting assembly 115 may be movably disposed in housing assembly 110 as described for example below.

The exemplary cutting device may be constructed from any suitable variety of durable materials or any other suitable materials. For example, some or most of the components of the exemplary cutting device may be formed from plastic or a plastic composite material. Also for example, some or most of the components of the exemplary cutting device may be formed from metal or metal alloy. Further for example, the exemplary cutting device may include ceramic material. For example, cutting device 105 may be formed from plastic, plastic composite, metal, metal alloy, and/or ceramic materials. For example, cutting device 105 may be formed from a variety of materials disclosed herein. For example, housing assembly 110 may be formed partially or substantially entirely from plastic, plastic composite, metal, and/or metal alloy materials. For example, housing assembly 110 may include plastic or metal structural members. Weights may be included in housing assembly 110 and/or cutting assembly 115 to help balance cutting device 105 during use, with the weights being formed for example from metal material. Cutting assembly 115 may include components formed from plastic, plastic composite, metal, metal alloy materials, and/or components formed from ceramic materials. Also for example, certain components of cutting device 105 may include specific materials based upon the application or function of a given component. For example, members of cutting device 105 designed to come into contact with a cutting surface and that may be subject to constant friction may include materials resistant to friction such as glass-filled nylon and/or polyamide plastic.

Housing assembly 110 may include a housing 120, an end assembly 125, and a movable member 130. End assembly 125 and movable member 130 may be received in a cavity of housing 120. Movable member 130 may be received within a recess of a portion of end assembly 125 so that movable member 130 is movably disposed within housing 120 as described for example below.

Housing 120 may provide, for example, a gripping surface for cutting device 105 for use by a user. For example, housing 120 may be a substantially hollow housing having a cavity 135 configured to receive and retain other portions of housing assembly 110 and cutting assembly 115. For example, housing 120 may be a cylindrical housing. Also for example, housing 120 may be any other suitable shape such as, for example, a tube shape, a square prism, triangular prism, a hexagonal prism, an octagonal prism, a polygonal prism, and/or any other desired shape (e.g., elongated shape).

As illustrated in FIGS. 5-8, housing 120 may include a wall portion 140 that may form cavity 135 and that may include an exterior surface 145 that users may grip to hold cutting device 105. Wall portion 140 may also include protrusions 150 disposed at exterior surface 145 that may assist a user in gripping cutting device 105 (e.g., during precision cutting). Housing 120 may also include an interior surface 155 forming a surface of cavity 135. As illustrated in FIGS. 5-8, interior surface 155 and cavity 135 may be shaped, dimensioned, and/or formed to retain other components of housing assembly 110 and portions of cutting assembly 115. Housing 120 may include recesses, apertures, cavities, protrusions, and/or any other suitable portions disposed at interior surface 155 that receive corresponding recesses, apertures, cavities, protrusions, and/or any other suitable portions of housing assembly 110 and portions of cutting assembly 115. For example, housing 120 may include elongated recesses disposed at interior surface 155 that receive a protrusion of cutting assembly 115 and thereby provide a track allowing for a predetermined movement of cutting assembly 115 within housing 120. For example, housing 120 may include a substantially straight recess that receives a portion of cutting assembly 115 to allow for a substantially straight movement of cutting assembly 115 as it moves within housing 120. Housing 120 may also include a recess disposed at interior surface 155 that receives a portion of end assembly 125 to allow for a predetermined (e.g., straight) movement of end assembly 125. Also for example, housing 120 may include protrusions disposed at interior surface 155 that are received in recesses disposed at exterior surfaces of other portions of housing assembly 110 or cutting assembly 115. As described herein, housing 120 may thereby retain and guide a movement of cutting assembly 115 and/or other portions of housing assembly 110 (e.g., end assembly 125 and/or movable member 130).

End assembly 125 may include an end member 160 and an actuating member 165. Actuating member 165 may be attached to end member 160 by any suitable technique such as, for example, adhesive, press-fit, snap-fit, threading, and/or any other suitable technique for attachment. For example as illustrated in FIG. 4, actuating member 165 may include threading 170 that may be threaded into threading 175 disposed on an interior surface of a cavity of end member 160.

Figure 9:
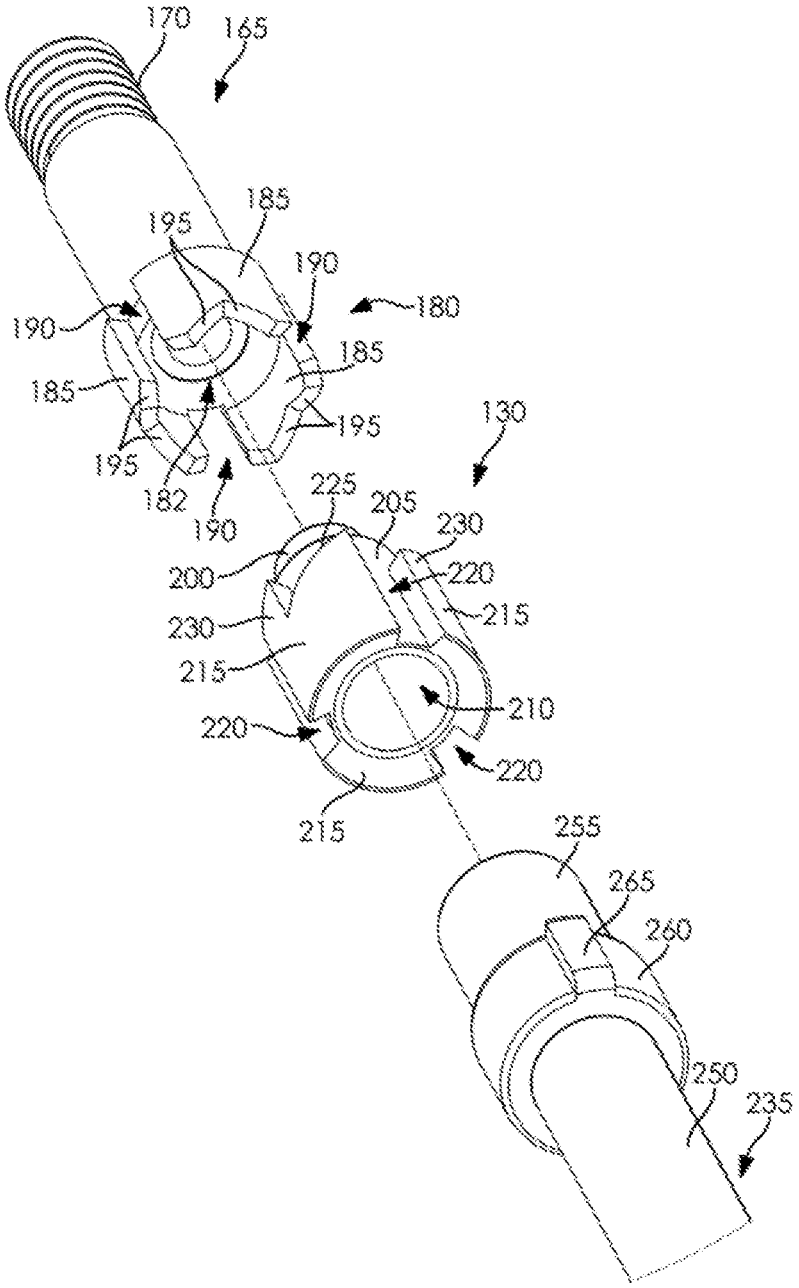
FIG. 9 is a perspective view of components of an exemplary cutting device in accordance with an embodiment of the present invention.

As illustrated in FIG. 9, actuating member 165 may also include a receiving portion 180. Receiving portion 180 may form a cavity 182 configured to receive a portion of movable member 130. Receiving portion 180 may include a plurality of wall portions 185 that are spaced from each via apertures 190. Each wall portion 185 may include a recess (e.g., notch or inwardly-shaped indention) formed by surfaces 195 that may be angled inward. For example, surfaces 195 may form inverted V-shaped recesses in wall portion 185. As described for example below, surfaces 195 of wall portions 185 may be configured to receive portions of movable member 130 to move movable member 130 based on an operation of cutting device 105.

Movable member 130 may include a protrusion 200 configured to be received in cavity 182 of actuating member 165. Movable member 130 may also include a wall portion 205 forming a cavity 210. A plurality of protruding portions 215 may protrude from wall portion 205. Protruding portions 215 may be spaced from each other via a plurality of apertures 220. Each protruding portion 215 may include a surface 225 and a portion 230. Surface 225 may be an angled surface that forms a V-shape with portion 230. For example, surface 225 and portion 230 may form notches or recessed portions that are raised above a surface of wall portion 205. As described for example herein, protruding portions 215 of movable member 130 may engage with and be biased by wall portions 185 of actuating member 165 to move movable member 130 based on an operation of cutting device 105 as described for example below. Also, apertures 190 of actuating member 165 and/or apertures 220 of movable member 130 may be selectively aligned with other portions of housing assembly 110 based on an operation of cutting device 105 as disclosed for example below.

As illustrated in FIGS. 4-8, cutting assembly 115 may include a body member 235, a blade assembly 240, and an urging member 245. Blade assembly 240 may be attached to body member 235, and urging member 245 may be disposed at an end portion of body member 235 at which blade assembly 240 may be attached. Cutting assembly 115 may be movably disposed within cavity 135 of housing 120 as disclosed for example herein.

Figure 7:
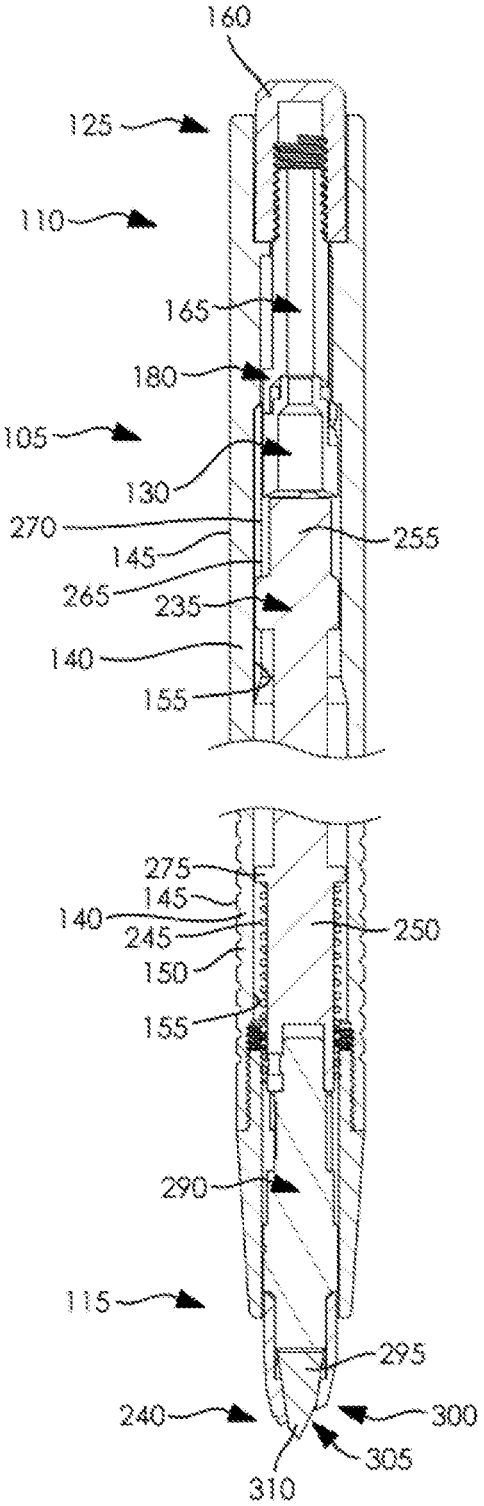
FIG. 7 is a sectional view of an exemplary cutting device in accordance with an embodiment of the present invention.
Figure 8:
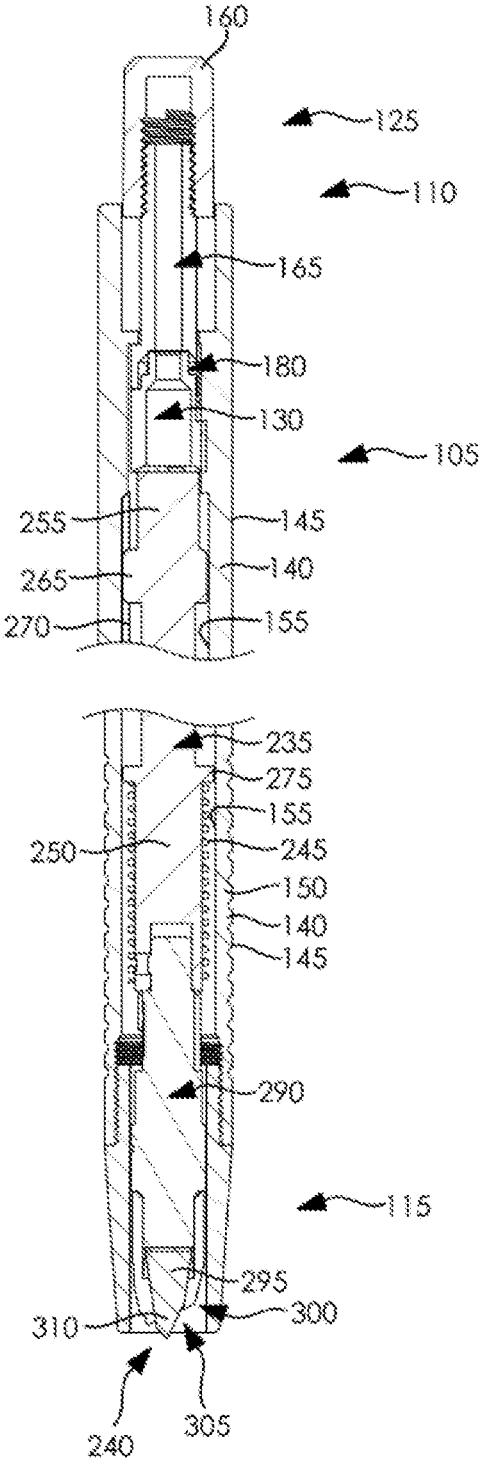
FIG. 8 is a sectional view of an exemplary cutting device in accordance with an embodiment of the present invention.

Body member 235 may include a shaft portion 250 that extends along a longitudinal direction of cutting device 105. For example, shaft portion 250 may extend along a longitudinal direction of cavity 135 of housing 120. Shaft portion 250 may include an end portion 255 that may abut against a rear portion of wall portion 205 and/or protruding portion 215 of movable member 130. As illustrated in FIG. 9, wall portion 205 and/or protruding portion 215 may for example form a small recess to receive a portion of end portion 255. A protruding portion 260 may be disposed on shaft portion 250 near end portion 255. Protruding portion 260 may be for example an annular portion such as an annular ring portion. As illustrated in FIGS. 5-8, protruding portion 260 may be sized to fit within cavity 135 so that protruding portion 260 fits within one or more portions of interior surface 155 to help guide a movement (e.g., a substantially straight movement) of cutting assembly 115 within housing 120. As illustrated in FIGS. 7-9, a protrusion 265 may protrude from an exterior portion of protruding portion 260. As illustrated in FIGS. 7 and 8, protrusion 265 may be received in a recess 270 of housing 120. Recess 270 may be an elongated recess that may guide a movement of protrusion 265 and cutting assembly 115. For example, recess 270 may be a substantially straight, elongated recess that receives protrusion 265 to provide for a substantially straight movement of body member 235 and cutting assembly 115 as cutting assembly 115 moves within housing 120.

As illustrated in FIGS. 4, 7, and 8, body member 235 may also include a protruding portion 275 disposed at an end portion 280 of shaft portion 250. Protruding portion 275 may be for example an annular portion such as an annular ring portion. Protruding portion 275 may be sized to fit within cavity 135 so that protruding portion 275 fits within one or more portions of interior surface 155 to help guide a substantially straight movement of cutting assembly 115 within cavity 135 of housing 120. Protruding portion 275 may also serve as an attachment point and/or retaining portion to help maintain urging member 245 in a desired position on cutting assembly 115. As illustrated in FIG. 4, body member 235 may also include an aperture 285 disposed at end portion 280. Aperture 285 may receive a portion of blade assembly 240 to help maintain an attachment between blade assembly 240 and body member 235.

Figure 5:
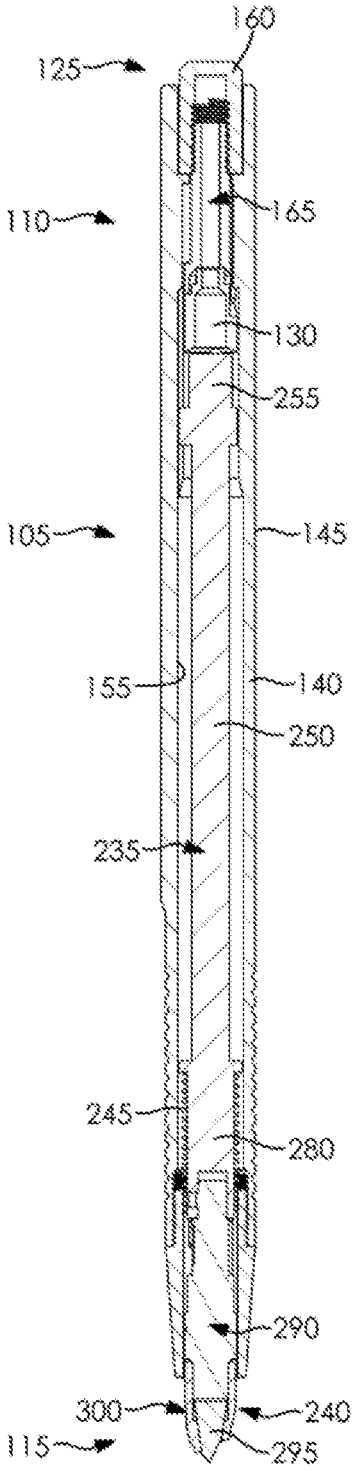
FIG. 5 is a sectional view of an exemplary cutting device in accordance with an embodiment of the present invention.
Figure 6:
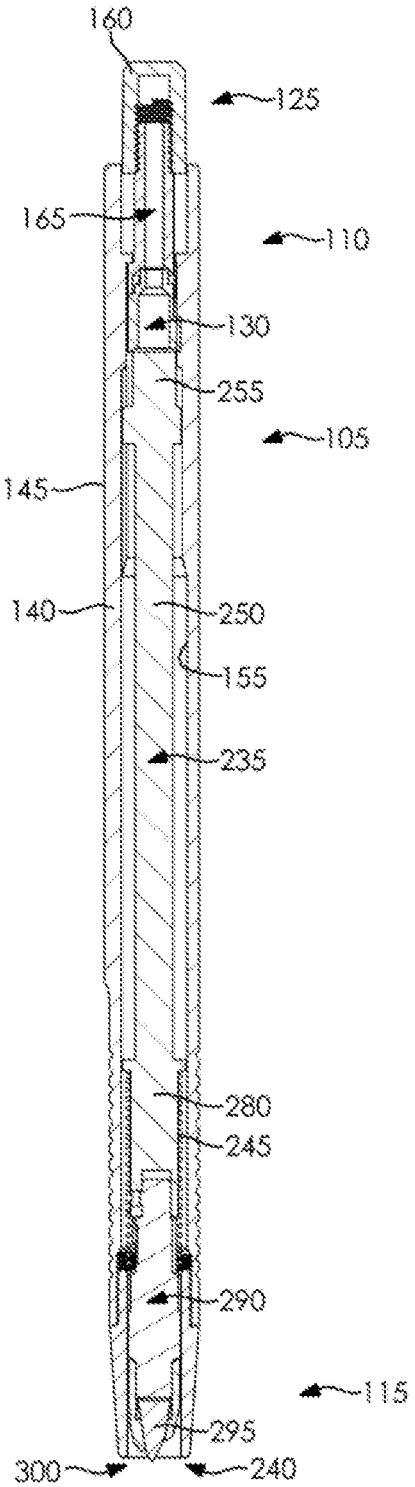
FIG. 6 is a sectional view of an exemplary cutting device in accordance with an embodiment of the present invention.

As illustrated in FIGS. 4-6, blade assembly 240 may include a blade retaining member 290, a cutting member 295, and a cover member 300. Cutting member 295 may be retained on blade retaining member 290 based on an attachment of cover member 300 to blade retaining member 290. Cover member 300 may include an aperture 305. Cutting member 295 may be received in a cavity of cover member 300, with a cutting portion 310 extending through aperture 305 as illustrated in FIGS. 7 and 8. Cover member 300 may be attached to blade retaining member 290 so that cutting member 295 is retained and attached to cutting assembly 115. Cover member 300 may be removably attachable to blade retaining member 290 so that cutting member 295 may be removed and replaced as desired. Cover member 300 may be removably attachable to blade retaining member 290 by any suitable technique such as, for example, snap-fitting, press-fitting, threading, and/or any other desired technique for attachment. As illustrated in FIG. 4, blade retaining member 290 may include a recess 315 that may receive a portion (e.g., a protrusion) disposed on an interior surface of housing 120 to help attach blade retaining member 290 to body member 235. Blade retaining member 290 may also include a protrusion 320 that may be received in aperture 285 of body member 235 to removably attach blade retaining member 290 to body member 235. It is also contemplated that blade assembly 240 may be attached in a fixed manner to body member 235.

Figure 20:
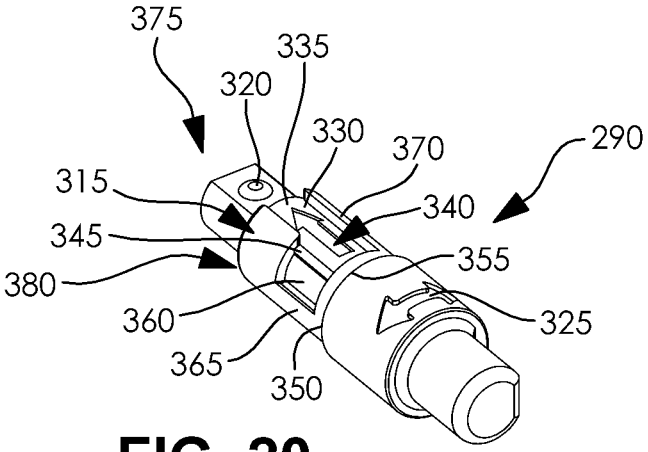
FIG. 20 is a perspective view of an exemplary cutting device in accordance with an embodiment of the present invention.

FIG. 20 provides a detailed view of at least some exemplary embodiments of blade retaining member 290. Blade retaining member 290 may include an indicator 325 that may be a rotation direction indicator to identify a desired direction of rotation (e.g., a clockwise direction) to a user. For example, indicator 325 may indicate to a user a desired direction of rotation for locking blade retaining member 290 in place in at least some exemplary embodiments. Blade retaining member 290 may also include an indicator 330 that may be a pushing direction indicator to identify a desired pushing direction to a user. For example, indicator 330 may indicate to a user a desired pushing direction for locking blade retaining member 290 in place in at least some exemplary embodiments. Indicators 325 and 330 may be any suitable type of indicator such as a printed indicator design, an etched indicator design, and/or any other suitable indicator (e.g., a printed or etched arrow).

As illustrated in FIG. 20, recess 315 may include a portion 335 and a portion 340. Portion 335 may be a longitudinal portion of recess 315 that extends in a longitudinal direction relative to blade retaining member 290. Portion 340 may be a transverse portion (e.g., a radial portion) of recess 315 that extends in a transverse direction relative to blade retaining member 290. Portion 340 may be substantially perpendicular to portion 335. When a portion of an exemplary disclosed housing assembly (e.g., as disclosed herein) is received in recess 315, the portion may move along portion 335 when moving in a longitudinal direction and along portion 340 when moving in a transverse direction. A protrusion 345 may be disposed in portion 340. Blade retaining member 290 may also include a portion 350 that may abut against one or more portions of the exemplary disclosed housing assembly (e.g., as disclosed herein) when blade retaining member 290 is disposed within the exemplary housing assembly.

Returning to FIGS. 4-6, cutting member 295 may be any suitable blade or cutter for cutting of a material by cutting device 105. For example, cutting member 295 may be formed from a ceramic material that is capable of withstanding extended use before becoming dull or unusable. Cutting member 295 may be any suitable blade for precision cutting. For example, cutting member 295 may be a ceramic blade. For example, cutting member 295 may include ceramic materials such as Zirconium Oxide or any other suitable ceramic materials for use in a blade. For example, cutting member 295 may be a ceramic blade that may be an angled or hooked blade formed from Zirconium Oxide. Alternatively for example, cutting member 295 may be a metal blade or a blade formed from any suitable material than can be used for cutting materials. Cutting member 295 may include rounded tips to reduce the chance of a user being cut unintentionally by cutting member 295.

Urging member 245 may be attached in a fixed manner or removably attachable at end portion 280 of body member 235. For example, urging member 245 may be attached at protruding portion 275 of body member 235 and may extend to a portion of blade retaining member 290. Urging member 245 may also be attached to interior surface 155 of housing 120. For example, a first end portion of urging member 245 may be attached to (e.g., or retained by) body member 235 and a second end portion of urging member 245 may be attached to (e.g., or retained by) housing 120 so that urging member 245 may compress and stretch based on a movement of body member 235 and cutting assembly 115 relative to housing 120 and housing assembly 110. Urging member 245 may apply an urging force that urges blade assembly 240 to move from an extended position to a retracted position within cavity 135 of housing 120 based on a movement of cutting assembly 115 as described for example below.

Urging member 245 may be a potential-energy-storing member. Urging member 245 may be any suitable member that may be for example stretched and unstretched and/or compressed and uncompressed. Urging member 245 may be urged or biased between a neutral or unbiased state (e.g., storing substantially no potential energy) and a biased state (e.g., storing potential energy). Urging member 245 may be, for example, a tension member or a compression member. For example, urging member 245 may be a spring having a plurality of coils. Urging member 245 may also be an elastic member or elastic band, a cable, a wire, and/or a member formed from materials having elastic or resilient properties and capable of being stretched and unstretched (e.g., or compressed and uncompressed). Urging member 245 may be formed from any suitable materials for forming a tension member or a compression member (e.g., that can be stretched and unstretched, or compressed and uncompressed) such as metallic material, plastic material, composite material, elastomeric material, natural rubber, and/or synthetic rubber. For example, urging member 245 may be a metallic, plastic, or composite spring. Also for example, urging member 245 may be a rubber band or an elastomeric cable, wire, or cord.

In at least some exemplary embodiments, an exemplary cutting device (e.g., cutting device 105) may include a housing assembly (e.g., housing assembly 110), a cutting assembly (e.g., cutting assembly 115) that is movably disposed in the housing assembly, the cutting assembly being movable in a first axis, between a retracted position and an extended position, and an urging member (e.g., urging member 245) that attaches the housing assembly to the cutting assembly. The cutting assembly may include a cutting member (e.g., cutting member 295). The cutting assembly may include an end assembly (e.g., end assembly 125), which may be actuatable in the first axis, and a movable member (e.g., movable member 130) that may be movable relative to the cutting assembly. When the end assembly is actuated, the urging member may bias the cutting assembly in the first axis toward the retracted position. When the end assembly is actuated, the end assembly may move the movable member in a second axis that is different from the first axis. The movable member may be a rotatable member. When the cutting assembly is in the retracted position, the cutting member may be disposed substantially entirely within the housing assembly. The end assembly may include a plurality of first angled surfaces (e.g., surfaces 195) that bear against a plurality of second angled surfaces (e.g., surfaces 225) of the movable member, and the first angled surfaces may slide relative to the second angled surfaces when the end assembly is actuated. The second axis may be substantially perpendicular to the first axis. The cutting assembly may include a protrusion (e.g., protrusion 265) that is received in an elongated recess (e.g., recess 270) disposed in an interior surface portion of the housing assembly. The elongated recess may be a substantially straight groove that is disposed substantially parallel to the first axis. The cutting member may be a ceramic blade. The cutting member may be removable. The urging member may be a spring.

In at least some exemplary embodiments, the exemplary cutting device (e.g., cutting device 105) may include a housing assembly (e.g., housing assembly 110), a cutting assembly (e.g., cutting assembly 115) that may be movably disposed in the housing assembly, the cutting assembly being movable in a first direction from a retracted position to an extended position, and in a second direction from the extended position to the retracted position, and a spring that may attach the housing assembly to the cutting assembly. The cutting assembly may include a ceramic blade. The cutting assembly may also include an end assembly, which may be actuatable in the first and second directions, and a rotatable member that may be rotatable relative to the cutting assembly. When the end assembly is actuated in the first direction, the spring may bias the cutting assembly in the second direction. When the end assembly is actuated in the first direction, the end assembly may rotate the rotatable member about a rotatable axis that is parallel to the first and second directions. When the cutting assembly is in the retracted position, the ceramic blade may be disposed substantially entirely within the housing assembly. The end assembly may include a plurality of first angled surfaces (e.g., surfaces 195) that bear against a plurality of second angled surfaces (e.g., surfaces 225) of the rotatable member, and the first angled surfaces may slide relative to the second angled surfaces when the end assembly is actuated in the first direction. The end assembly may include a plurality of apertures (e.g., apertures 190) that selectively align with a plurality of portions (e.g., portions 230) of the rotatable member based on a rotation of the rotatable member. When the cutting assembly is in the retracted position, the plurality of portions of the rotatable member may be received in the plurality of recesses of the end assembly. The cutting assembly may include a body member (e.g., body member 235) that is non-rotatable relative to the housing assembly, the end assembly may be non-rotatable relative to the housing assembly, and the rotatable member may be rotatable relative to the housing assembly.

The exemplary cutting device disclosed herein may be any suitable device for cutting material such as, for example, a cutting device used for precision cutting of material. For example, the exemplary cutting device may be any suitable cutting device for precisely cutting material for use in technical applications such as engineering and manufacturing, artistic or graphic design, construction, or any other suitable activity involving precise cutting of objects or materials.

An exemplary operation of cutting device 105 will now be described. As illustrated in FIG. 6, cutting device 105 may be stored, carried, or transported for example in a retracted position in which blade assembly 240 of cutting assembly 115 is substantially fully retracted within cavity 135 of housing 120. In the retracted position as illustrated for example in FIG. 8, end assembly 125 may extend out from cavity 135 of housing 120 (e.g., from an end portion of housing 120 that is distal from an end portion from which blade assembly 240 may extend). In the retracted position, urging member 245 may be in a neutral or unbiased state (e.g., storing substantially no potential energy). For example, urging member 245 may be an uncompressed spring in a neutral state when cutting device 105 is in the retracted position. It is also contemplated that urging member 245 may be in a biased state and/or may be a spring in a compressed state when cutting device 105 is in the retracted position.

A user may change (e.g., switch) cutting device 105 from the retracted position to an extended position. The user may press on end member 160 to urge end assembly 125 into cavity 135 of housing 120. Cutting device 105 may thereby move from the exemplary retracted position illustrated in FIG. 8 to the exemplary extended position illustrated in FIG. 7. As illustrated in FIG. 7, the user may move end member 160 into cavity 135 so that it is seated on a portion of housing 120, thereby moving end member 160 and actuating member 165 toward a central portion of cavity 135. As actuating member 165 is moved, it may exert an actuating force on movable member 130. Movable member 130 may thereby apply an actuating force to body member 235, which may apply an actuating force to urging member 245. Based on the actuating force of the user pressing on end member 160, the entire cutting assembly 115 may be moved within housing 120. Blade assembly 240 may thereby be extended from cavity 135 of housing 120, causing cutting member 295 to emerge from a front portion of cavity 135 as illustrated in FIG. 7. As cutting device 105 moves from the retracted position illustrated in FIG. 8 to the extended position illustrated in FIG. 7, urging member 245 may move from an uncompressed (e.g., neutral) unbiased state to a compressed biased state, thereby storing an increasing amount of potential energy. It is also contemplated that urging member 245 may move to an uncompressed state when cutting device 105 is in the extended position.

As cutting device 105 moves from the retracted position to the extended position and cutting assembly 115 actuates (e.g., compresses) urging member 245, actuating member 165 bears against movable member 130. In the retracted position, portions 230 of movable member 130 may be received in apertures 190 of actuating member 165. Surfaces 225 of movable member 130 may bear against surfaces 195 of actuating member 165. As the user presses end member 160 and moves cutting device 105 from the retracted position to the extended position, surfaces 225 of movable member 130 may bear and urge against surfaces 195 of actuating member 165, causing portions 230 of movable member 130 to move out of apertures 190 of actuating member 165. Once portions 230 of movable member 130 have been completely removed from apertures 190 of actuating member 165, angled surfaces 225 of movable member 130 may slide relative to surfaces 195 of actuating member 165. For example, an urging action (e.g., cam action) may result based on surfaces 225 sliding relative to surfaces 195, causing movable member 130 to rotate relative to actuating member 165 and body member 235. Portions 230 may slide along surfaces 195 and be received in the V-shaped recesses or notches formed between adjacent surfaces 195. At this point, cutting device 105 may be in the extended position illustrated in FIG. 7. The user may release end member 160, and cutting assembly 115 may remain in the extended position based on portions 230 of movable member 130 being retained in the recesses or notches formed by adjacent surfaces 195 of actuating member 165. Urging member 245, which may be in a biased (e.g., compressed) state storing potential energy, may apply an urging force that helps to maintain portions 230 in recesses or notches formed by adjacent surfaces 195. End member 160 and cutting assembly 115 may retract slightly to the position shown in FIG. 1 when the user releases end member 160. Cutting device 105 may be maintained in the extended position as described above (e.g., by urging member 245 applying an urging force that helps to maintain portions 230 in recesses or notches formed by adjacent surfaces 195) after the user releases end member 160. The user may then use cutting device 105 maintained as described above in the extended position as desired.

When the user is finished with a cutting operation and desires to for example, transport, store, or carry cutting device 105, the user may change (e.g., switch) cutting device 105 from the extended position back to the retracted position. The user may press on end member 160 to urge end assembly 125 into cavity 135 of housing 120. The user may apply an actuating force on end member 160 that is greater than the urging force of urging member 245, thereby causing the entire cutting assembly 115 to be moved within housing 120. As the user presses end member 160, surfaces 195 of actuating member 165 push against portions 230 of movable member 130. For example, a sliding action (e.g., cam action) may result based on surfaces 195 sliding relative to portions 230, causing movable member 130 to rotate relative to actuating member 165 and body member 235. Portions 230 may slide along (e.g., up along) surfaces 195 so that portions 230 are removed from recesses or notches formed by adjacent surfaces 195. Portions 230 may thereby be pushed toward apertures 190 of actuating member 165. Once portions 230 of movable member 130 are substantially aligned with apertures 190 of actuating member 165, substantially no surfaces of movable member 130 and actuating member 165 may be bearing against each other (e.g., notwithstanding that the user may still be pushing on end member 160). The biasing or urging force of urging member 245 may then push movable member 130 toward actuating member 165 so that portions 230 are pushed into apertures 190. The entire cutting assembly 115 may thereby be moved within cavity 135 of housing 120 based on urging by urging member 245. Cutting device may thereby be moved from an exemplary extended position as illustrated in FIG. 1 to an exemplary retracted position as illustrated in FIG. 6. The user may then for example carry, store, or transport cutting device 105 as desired. Cutting device 105 may be changed (e.g., switched) between the retracted position and the extended position as desired as described above.

The user may also replace worn or dull cutting members 295 with cutting members 295 as desired. For example, when cutting device 105 is in the extended position, the user may remove portions of cutting device 105 to replace cutting member 295. The user may for example remove (e.g., unsnap, unscrew, or make any other suitable detachment) cover member 300 to uncover blade retaining member 290. The user may then replace cutting member 295 and reattach cover member 300.

Alternatively for example, when cutting device 105 is in the retracted position and urging member 245 is in the unbiased or neutral position in which substantially no potential energy is stored, the user may remove additional portions of cutting device 105 to replace cutting member 295. For example, the user may remove a removably attachable portion of housing 120 to access blade assembly 240. The user may remove cover member 300 and remove blade retaining member 290 from body member 235 and/or housing 120. For example, the user may twist blade retaining member 290 to disengage and remove it from body member 235 and/or housing 120. The user may then replace cutting member 295 on detached blade retaining member 290, reattach blade retaining member 290 to body member 235 and/or housing 120, and reattach cover member 300 (e.g., and/or a removable portion of housing 120). The user may also remove and replace an existing blade retaining member 290 with a new blade retaining member 290. For example, blade retaining member 290 may be a removable and/or replaceable cartridge. It is also contemplated that blade retaining member 290 may be removably attached to a plurality of different cutting devices Any suitable mechanical configuration of housing assembly 110 and/or cutting assembly 115 may be used to facilitate blade change of cutting member 295.

The exemplary method may include providing a cutting assembly (e.g., cutting assembly 115) in a housing assembly (e.g., housing assembly 110), removably attaching a cutting member (e.g., cutting member 295) to the cutting assembly, moving the cutting assembly in the housing assembly in a first direction from a retracted position to an extended position, and moving the cutting assembly in the housing assembly in a second direction from the extended position to the retracted position. The exemplary method may also include biasing the cutting assembly in the second direction with an urging force, actuating the cutting assembly in the first direction with an actuating force that is greater than the urging force, and moving a movable member (e.g., movable member 130) of the cutting assembly in a third direction that is different from the first and second directions. When the cutting assembly is in the retracted position and the cutting member is attached to the cutting assembly, the cutting member may be disposed substantially entirely within the housing assembly. The first and second directions may be substantially parallel to a longitudinal axis of the cutting assembly and a longitudinal axis of the cutting member. The third direction may be a rotational direction about the longitudinal axis of the cutting assembly and the longitudinal axis of the cutting member.

FIGS. 10-19 illustrate another exemplary embodiment of the exemplary disclosed cutting device. Cutting device 405 may include a housing assembly 410, a cutting assembly 415, and a cover member 420. Cutting assembly 415 may be removably disposable in housing assembly 410, and cover member 420 may be removably disposable on one or more portions of housing assembly 410, as described for example below.

Housing assembly 410 may include a housing 425 and an end assembly 430. End assembly 430 may be disposed at an end portion of housing 425 and may receive cover member 420 as described for example below.

Figure 13:
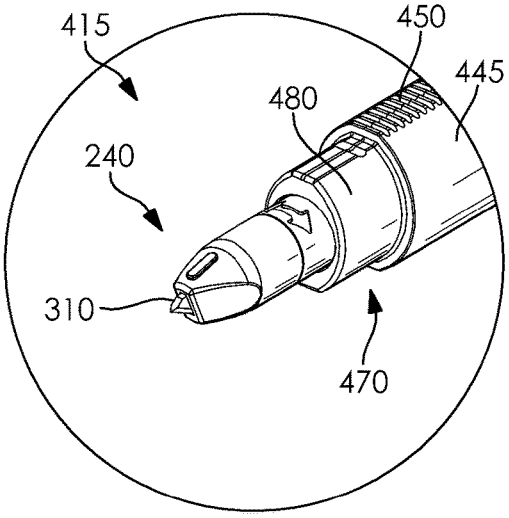
FIG. 13 is a perspective view of an exemplary cutting device in accordance with an embodiment of the present invention.
Figure 14:
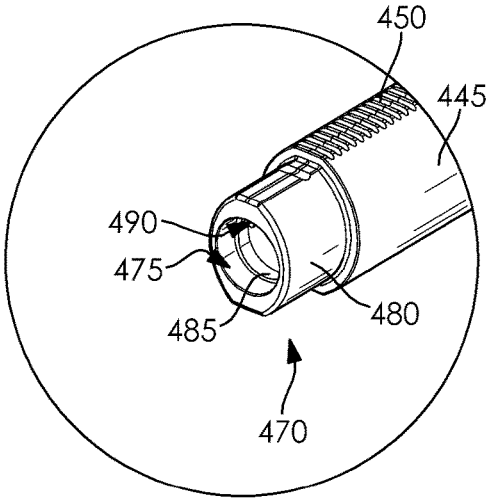
FIG. 14 is a perspective view of an exemplary cutting device in accordance with an embodiment of the present invention.
Figure 15:
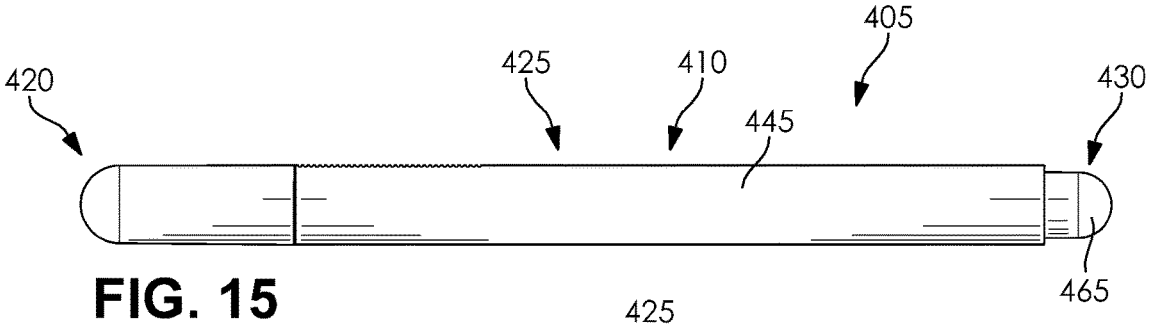
FIG. 15 is a side view of an exemplary cutting device in accordance with an embodiment of the present invention.
Figure 16:
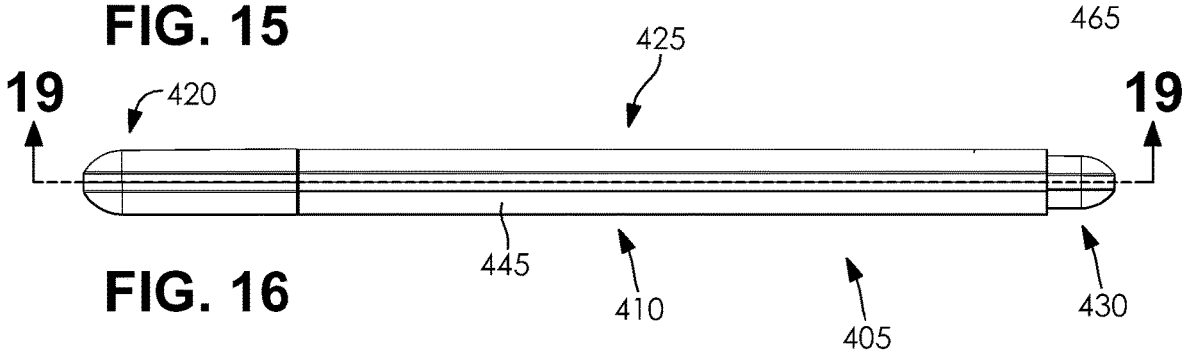
FIG. 16 is a top view of an exemplary cutting device in accordance with an embodiment of the present invention.
Figure 17:
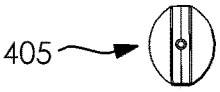
FIG. 17 is a front view of an exemplary cutting device in accordance with an embodiment of the present invention.
Figure 18:
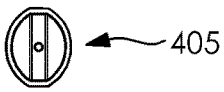
FIG. 18 is a rear view of an exemplary cutting device in accordance with an embodiment of the present invention.
Figure 19:
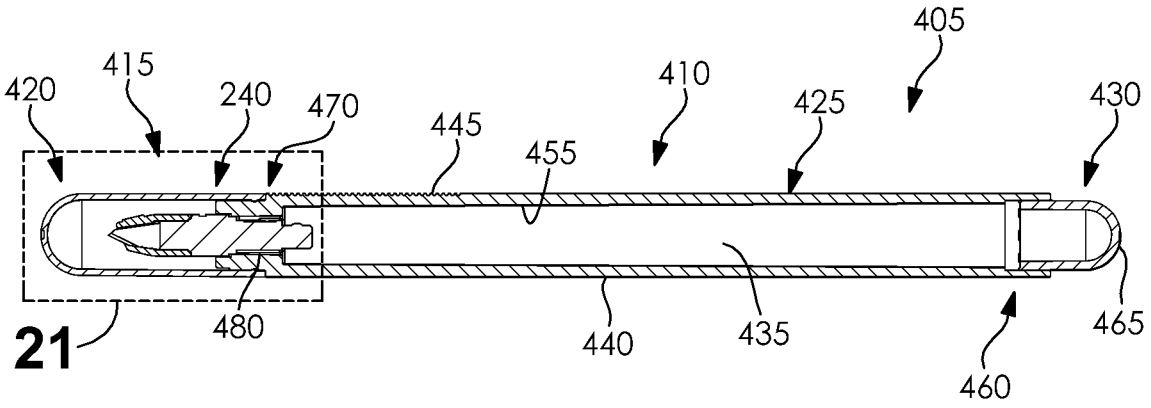
FIG. 19 is a sectional view of an exemplary cutting device in accordance with an embodiment of the present invention.

Housing 425 may provide a gripping surface and have a shape similar to as described above regarding housing 120. For example as illustrated in FIG. 19, housing 425 may include a wall portion 440 that may form a cavity 435 and that may include an exterior surface 445 that users may grip to hold cutting device 405. For example as illustrated in FIGS. 13 and 14, wall portion 440 may also include protrusions 450 disposed at exterior surface 445 that may assist a user in gripping cutting device 405 (e.g., during precision cutting). As illustrated for example in FIG. 19, housing 425 may also include an interior surface 455 forming a surface of cavity 435. Interior surface 455 and cavity 435 may be shaped, dimensioned, and/or formed to retain other components of housing assembly 410, portions of cutting assembly 415, and cover member 420. Cavity 435 may for example be a substantially hollow cavity that may help to provide a light-weight feel and handling for cutting device 405. Cavity 435 may also for example be configured to hold a weight (e.g., metal weight) and/or any other suitable solid or fluid (e.g., gel) material for providing a desired balanced feel and handling for cutting device 405.

As illustrated for example in FIG. 19, housing 425 may also include an end portion 460 that may be configured to receive or be attached to end assembly 430. End portion 460 may be attached to end assembly 430 by any suitable technique. For example, end portion 460 and end assembly 430 may be removably attached or permanently attached. In at least some exemplary embodiments, end portion 460 may be attached to end assembly 430 by any suitable attachment technique such as, for example, adhesive, press-fit, snap-fit, threading, and/or any other suitable technique for attachment. In at least some exemplary embodiments, end portion 460 may be integrally formed with end assembly 430 as an integral portion of housing 425. End portion 460 may be configured to removably receive cover member 420. For example, an exterior surface 465 of end portion 460 may be configured to be received by (e.g., fit within and/or against) an interior surface of cover member 420.

Figure 12:
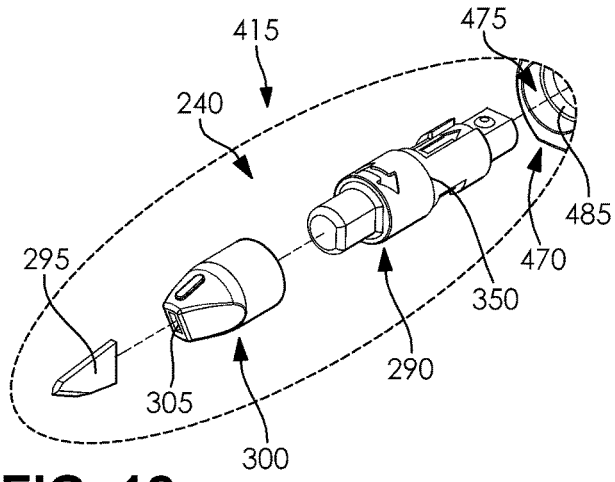
FIG. 12 is a perspective view of an exemplary cutting device in accordance with an embodiment of the present invention.
Figure 21:
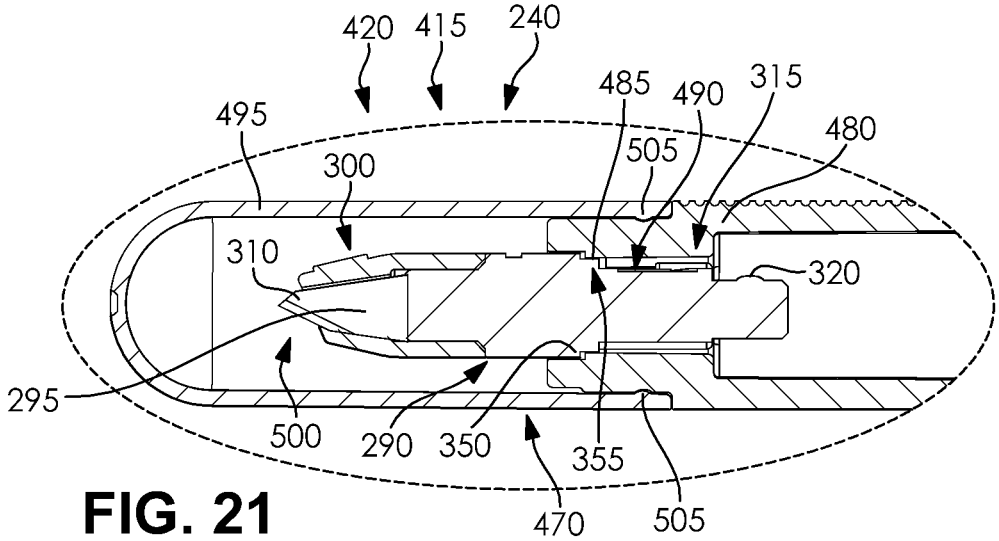
FIG. 21 is a sectional view of an exemplary cutting device in accordance with an embodiment of the present invention.

As illustrated for example in FIGS. 11-14 and 19, housing 425 may also include an end portion 470 that may be configured to removably receive cutting assembly 415. End portion 470 may include a cavity 475 that may be configured to receive a portion of cutting assembly 415. Cavity 475 may be formed by a wall portion 480 of housing 425. As illustrated in FIGS. 12, 14, and 21, end portion 470 may include a protrusion 485 disposed on an interior surface of wall portion 480 facing cavity 475. Protrusion 485 may abut against a portion of cutting assembly 415 when cutting assembly 415 is disposed (e.g., partially disposed) in cavity 475. As illustrated in FIGS. 14 and 21, end portion 470 may also include a protrusion 490 disposed on the interior surface of wall portion 480 facing cavity 475. Protrusion 490 may be received in a portion of cutting assembly 415 as described below. Protrusions 485 and 490 may be attached to housing 425 by any suitable technique and/or may be integral portions of housing 425.

Figure 10:
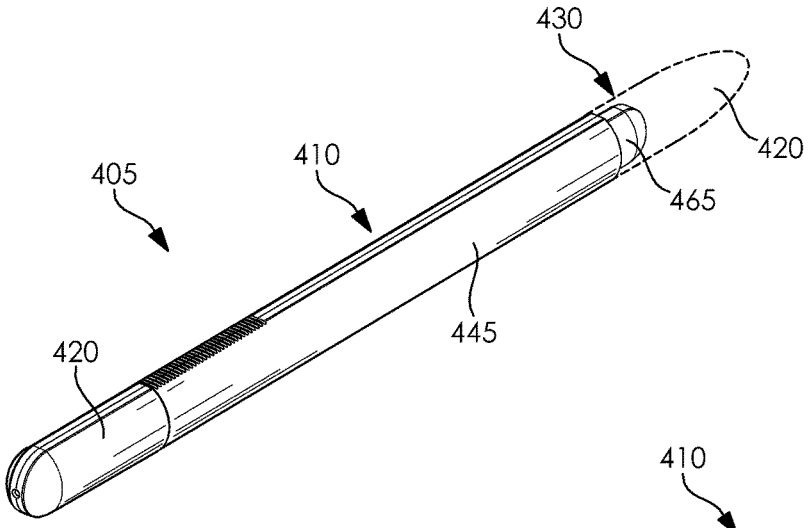
FIG. 10 is a perspective view of an exemplary cutting device in accordance with an embodiment of the present invention.
Figure 11:
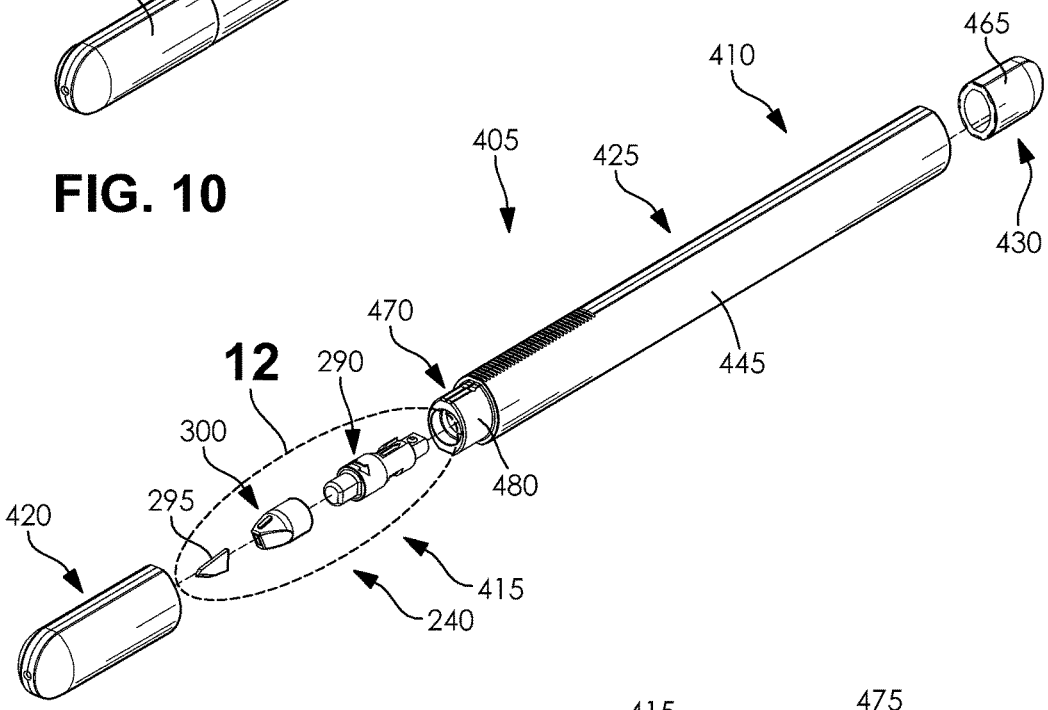
FIG. 11 is a perspective view of an exemplary cutting device in accordance with an embodiment of the present invention.

Cover member 420 may be selectively removably attached to end assembly 430 and end portion 470 of housing assembly 410. As illustrated in FIG. 21, cover member 420 may include a wall portion 495 that may form a cavity 500. Wall portion 495 may include one or more protrusions 505 that may be received by corresponding recesses of end assembly 430 and/or end portion 470 so that cover member 420 may be secured to housing assembly 410. For example as illustrated in FIG. 10, cover member 420 may be selectively disposed on end portion 470 (e.g., as illustrated in solid lines in FIG. 10) or on end assembly 430 (e.g., as illustrated in dashed lines in FIG. 10). For example, cover member 420 may be secured to end assembly 430 when cutting device 405 is in use, and may be secured to end portion 470 when cutting device 405 is not in use (e.g., when cutting device 405 is being stored or transported). Cover member 420 may thereby remain selectively attached to housing assembly 410 to help avoid loss or misplacement of cover member 420 by a user of cutting device 405.

Cutting assembly 415 may include blade assembly 240 that may include blade retaining member 290, cutting member 295, and cover member 300 as described above. That is, in at least some exemplary embodiments, both cutting assembly 115 of cutting device 105 and also cutting assembly 415 of cutting device 405 may selectively include identical (e.g., selectively include the same) blade assembly 240 including blade retaining member 290, cutting member 295, and cover member 300. For example as described further below, the same blade assembly 240 including blade retaining member 290, cutting member 295, and cover member 300 may be selectively used in various cutting devices of varying configurations (e.g., cutting devices 105 and 405). It is also contemplated that a first blade assembly 240 may be used in cutting device 105 that is not identical to a second blade assembly 240 that may be used in cutting device 405.

An exemplary method for using blade assembly 240 in both cutting device 405 and cutting device 105 will now be described. As illustrated in FIGS. 12 and 14, end portion 470 of cutting device 405 may be configured to removably receive blade retaining member 290. Cover member 300 may secure cutting member 295 and be attached to blade retaining member 290. As illustrated in FIGS. 13 and 21, blade retaining member 290 may be removably attached to end portion 470 so that blade assembly 240 is removably attached to housing assembly 410.

For example as illustrated in FIG. 21, blade assembly 240 may be inserted into cavity 475 until one or more portions 350 of blade retaining member 290 contacts and bears against protrusion 485 of end portion 470. As blade assembly 240 is inserted into cavity 475, protrusion 490 of end portion 470 may move along recess portion 335 of recess 315. Blade assembly 240 may be inserted into cavity 475 until a portion of protrusion 490 of end portion 470 contacts and/or bears against a wall portion (e.g., a wall portion 355) of recess 315. Once blade assembly 240 is inserted into cavity 475 so that protrusion 490 of end portion 470 contacts wall portion 355, blade assembly 240 may be rotated. For example, blade assembly 240 may be rotated in a direction of indicator 325 (e.g., a clockwise direction). As blade assembly 240 is rotated, protrusion 490 of end portion 470 may move along recess portion 340 of recess 315. Protrusion 490 of end portion 470 may be urged (e.g., urged by rotational force applied to blade assembly 240 by a user) over protrusion 345 of blade retaining member 290. A user may notice (e.g., by sound and/or feel) protrusion 490 passing over protrusion 345 and entering a portion 360 of recess portion 340. Rotational force applied by the user may be stopped, and protrusion 490 of end portion 470 may be maintained in place (e.g., locked in placed) in portion 360 between a wall portion 365 of blade retaining member 290 and protrusion 345 of blade retaining member 290. Protrusion 490 held in this position may thereby help to securely maintain an attachment of cutting assembly 415 to housing assembly 410. In at least some exemplary embodiments, protrusion 320 may not bear against portions of housing 425, and instead may be disposed in cavity 435 of housing 425. It is also contemplated that protrusion 320 may be received in a recess of housing 425 when cavity 435 is partially or substantially entirely filled with material and/or includes any other suitable portions configured to receive protrusion 320. Cover member 420 may for example be removably attached to end portion 470 to cover cutting member 295 of cutting assembly 415 and/or may be removably attached to end assembly 430.

Cutting assembly 415 may be secured in place to housing assembly 410 for example when cutting device 405 is used for cutting, transported, stored, or used in any other desired application. When desired, a user may detach blade assembly 240 from housing assembly 410. Blade assembly 240 may be rotated in a direction opposite to that shown by indicator 325 (e.g., a counter-clockwise direction). As blade assembly 240 is rotated, protrusion 490 of end portion 470 may be urged (e.g., urged by rotational force applied to blade assembly 240 by a user) over protrusion 345 and out of portion 360 of blade retaining member 290. Protrusion 490 of end portion 470 may move along recess portion 340 of recess 315 until contacting a wall portion 370 of recess 315. Blade assembly 240 may then be pulled from cavity 475, thereby removing cutting assembly 415 from housing assembly 410. Cover member 300 may be detached from blade retaining member 290 to remove cutting member 295 if desired (e.g., to replace an existing cutting member 295 with a new cutting member 295).

Figure 22:
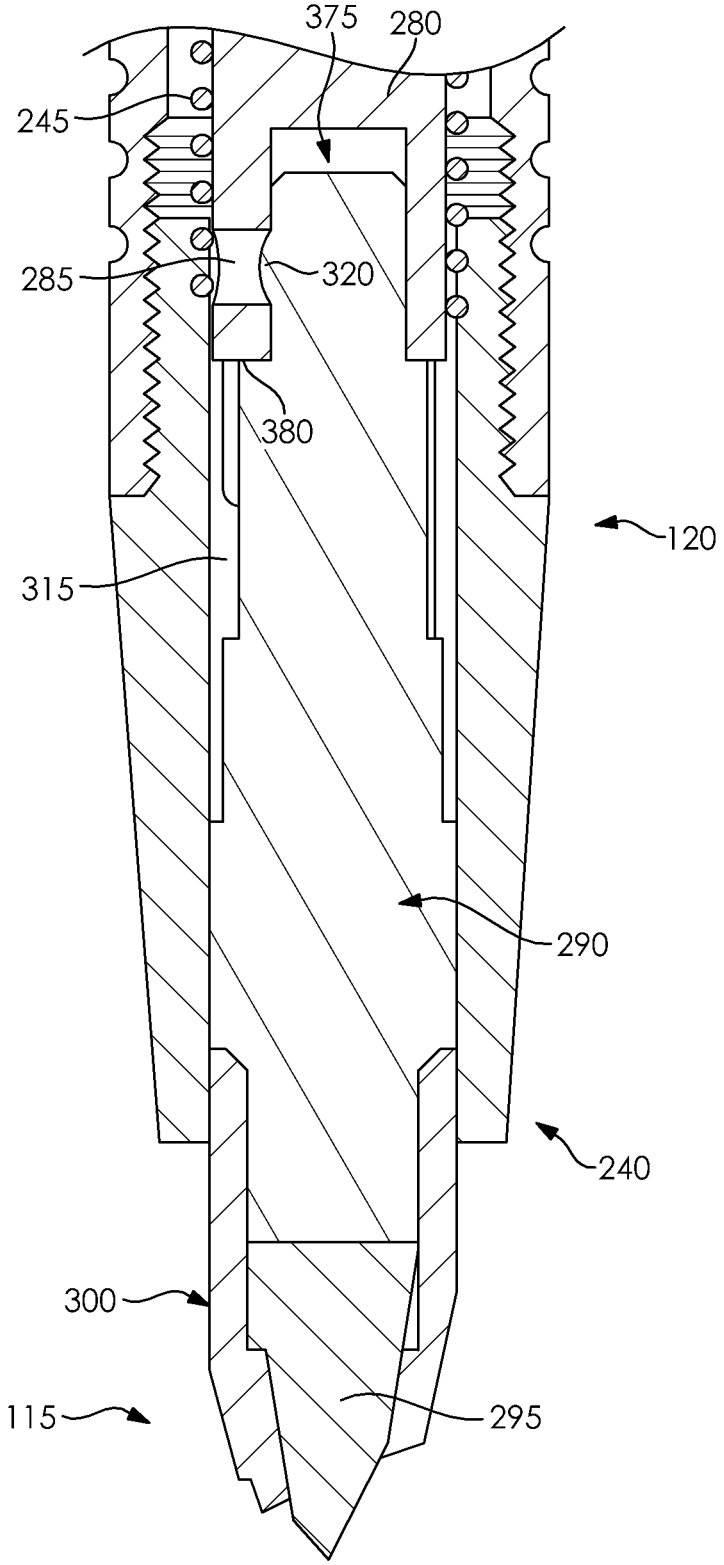
FIG. 22 is a sectional view of an exemplary cutting device in accordance with an embodiment of the present invention.

After selectively comprising cutting assembly 415 of cutting device 405 as described for example above, blade assembly 240 may then be used as part of cutting assembly 115, which may be removably attached to housing assembly 110 of cutting device 105. As illustrated in FIG. 4, end portion 280 of body member 235 of cutting device 105 may be configured to removably receive blade retaining member 290. Cover member 300 may secure cutting member 295 and be attached to blade retaining member 290. As illustrated in FIGS. 4 and 22, blade retaining member 290 may be removably attached to end portion 280 so that blade assembly 240 is removably attached to housing assembly 110 of cutting device 105. Blade assembly 240 may thereby form a part of cutting assembly 115.

As illustrated in FIGS. 4 and 22, urging member 245 may be disposed against protruding portion 275, and a protruding portion 375 of blade retaining member 290 may be inserted into a cavity of end portion 280 of body member 235. Protruding portion 375 may have a shape that corresponds to a shape of the cavity of end portion 280 so that a user may insert blade retaining member 290 into the cavity of end portion 280 at a desired exemplary alignment. For example based on the corresponding shape of protruding portion 375 and the cavity of end portion 280, protrusion 320 of blade retaining member 290 may be aligned with aperture 285 of end portion 280 in a longitudinal direction of cutting device 105 when protruding portion 375 of blade retaining member 290 is inserted into the cavity of end portion 280 of body member 235. Protruding portion 375 may be pushed into the cavity of end portion 280 until a wall portion 380 of blade retaining member 290 contacts and bears against a tip portion of end portion 280. Also in this position as illustrated in FIG. 22, protrusion 320 of blade retaining member 290 may be received in aperture 285 of end portion 280 of body member 235. Blade assembly 240 may be thereby securely attached to body member 235 based on aperture 285 receiving protrusion 320, and wall portion 380 contacting the tip portion of end portion 280. Cutting assembly 115 (e.g., including blade assembly 240) may thereby be securely attached to housing assembly 110 of cutting device 105.

In at least some exemplary embodiments, portions of cutting device 105 may not be received in recess 315 of blade retaining member 290, when cutting assembly 115 is removably attached to housing assembly 110, as illustrated for example in FIG. 22. It is also contemplated that cutting device 105 may include suitable portions (e.g., portions that may be disposed on an interior surface of housing 120 facing cavity 135) that may be received in recess 315.

Cutting assembly 115 may be secured in place to housing assembly 110 for example when cutting device 105 is used for cutting, transported, stored, or used in any other desired application. When desired, a user may detach blade assembly 240 from housing assembly 110. A user may apply a pulling force to blade assembly 240 to pull blade assembly 240 out of housing assembly 110 in a longitudinal direction of cutting device 105. Based on the pulling force, protrusion 320 may be moved (e.g., slid) out of aperture 285. Blade assembly 240 may then be pulled from the cavity of end portion 280, thereby removing blade assembly 240 from the other components of cutting assembly 115 and from housing assembly 110. Cover member 300 may be detached from blade retaining member 290 to remove cutting member 295 if desired (e.g., to replace an existing cutting member 295 with a new cutting member 295).

Blade assembly 240 may be selectively used as a part of either cutting device 405 or cutting device 105 (e.g., or any other suitable cutting device) based on user preference as described for example herein.

In at least some exemplary embodiments, the exemplary disclosed apparatus may include a blade retaining member (e.g., blade retaining member 290) that may be elongated in a longitudinal direction, a recess (e.g., recess 315) disposed in the blade retaining member, the recess having a first portion (e.g., portion 335) extending in the longitudinal direction and a second portion (e.g., portion 340) extending in a radial direction, a protruding portion (e.g., protruding portion 375) that extends from the blade retaining member in the longitudinal direction, and a protrusion (e.g., protrusion 320) disposed on the protruding portion. The recess may be a first attachment portion configured to removably attach exemplary disclosed apparatus to a first cutting device. The protrusion may be a second attachment portion configured to removably attach the exemplary disclosed apparatus to a second cutting device. The exemplary disclosed apparatus may further include a blade (e.g., cutting member 295) and a cover member (e.g., cover member 300) that is removably attachable to the blade retaining member. The cover member may include a cavity having an aperture. The blade may be configured to be received in the cavity of the cover member and a portion of the blade may be configured to extend out of the aperture when the cover member is attached to the blade retaining member. The blade may be a ceramic blade. The second portion extending in the radial direction may be a radial recess portion extending perpendicularly to the first portion. The protruding portion may be configured to be received in a cavity of the second cutting device.

In at least some exemplary embodiments, the exemplary disclosed method may include removably attaching a cutting member (e.g., cutting member 295) to a blade retaining member (e.g., blade retaining member 290), removably attaching the blade retaining member to a first cutting device using a recess (e.g., recess 315) disposed in the blade retaining member, and removably attaching the blade retaining member to a second cutting device using a retaining protrusion (e.g., protrusion 320) disposed on a protruding portion (e.g., protruding portion 375) of the blade retaining member. Removably attaching the blade retaining member to the first cutting device may include moving a first-cutting-device protrusion (e.g., protrusion 490) of the first cutting device in the recess based on moving the blade retaining member within a cavity of the first cutting device. Removably attaching the blade retaining member to the second cutting device may include inserting the protruding portion of the blade retaining member in a cavity of the second cutting device and receiving the retaining protrusion in an aperture (e.g., aperture 285) included in a wall that forms the cavity of the second cutting device. The first cutting device may have a first configuration that is different from a second configuration of the second cutting device. Moving the first-cutting-device protrusion of the first cutting device in the recess may include moving the first-cutting-device protrusion in a longitudinal portion (e.g., portion 335) of the recess based on pushing or pulling the protruding portion in the cavity of the first cutting device. Moving the first-cutting-device protrusion of the first cutting device in the recess may include moving the first-cutting-device protrusion in a radial portion (e.g., portion 340) of the recess based on rotating the protruding portion in the cavity of the first cutting device. The exemplary disclosed method may further include locking the first-cutting-device protrusion in place in the radial portion of the recess by moving the first-cutting-device protrusion over a radial portion protrusion (e.g., protrusion 345) disposed in the radial portion of the recess. A shape of the protruding portion of the blade retaining member may correspond to a shape of the cavity of the second cutting device. The retaining protrusion may be aligned in a longitudinal direction with the aperture when the protruding portion is inserted in the cavity of the second cutting device, based on the shape of the protruding portion of the blade retaining member corresponding to the shape of the cavity of the second cutting device.

In at least some exemplary embodiments, the exemplary disclosed cutting system may include a removably-attachable blade assembly (e.g., blade assembly 240) including a blade retaining member (e.g., blade retaining member 290), a recess (e.g., recess 315) disposed in the blade retaining member, a protruding portion (e.g., protruding portion 375) that extends from the blade retaining member, and a retaining protrusion (e.g., protrusion 320) disposed on the protruding portion, a first cutting device including a first-cutting-device protrusion (e.g., protrusion 490) configured to be received in the recess when the removably-attachable blade assembly is inserted in a cavity of the first cutting device, and a second cutting device including a cavity formed by a wall including an aperture (e.g., aperture 285), the aperture configured to receive the retaining protrusion when the removably-attachable blade assembly is inserted in the cavity of the second cutting device. The recess may have a first portion (e.g., portion 335) extending in a longitudinal direction of the blade retaining member and a second portion (e.g., portion 340) extending in a radial direction of the blade retaining member. The first-cutting-device protrusion may move in the first portion of the recess based on pushing or pulling the protruding portion in the cavity of the first cutting device. The first-cutting-device protrusion may move in the second portion of the recess based on a rotation of the protruding portion in the cavity of the first cutting device. The first-cutting-device protrusion may be locked in place in the second portion of the recess based on moving the first-cutting-device protrusion over a second portion protrusion (e.g., protrusion 345) disposed in the second portion of the recess. The retaining protrusion may be aligned in a longitudinal direction with the aperture when the protruding portion is inserted in the cavity of the second cutting device, based on a shape of the protruding portion corresponding to a shape of the cavity of the second cutting device. The first cutting device may have a first configuration that is different from a second configuration of the second cutting device.

The exemplary disclosed device and method may provide an intuitively simple and safe technique for using a cutting device for the precision cutting of materials. The exemplary disclosed device and method may provide a quick and efficient way to change between a mode in which a blade is exposed and a mode in which a blade is safely covered or retracted. The exemplary disclosed device and method may also provide a technique for avoiding loss or misplacement of blade covers and avoiding accidental cutting by or damage to cutting members. The exemplary disclosed device and method may also provide a technique for efficiently replacing and reusing blade cartridges (e.g., such as blade assembly 240) between multiple cutting devices.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A removably-attachable blade cartridge, comprising:

a blade retaining member that is elongated to define a longitudinal axis;

a recess, which is substantially L-shaped, disposed in the blade retaining member, the recess having a first portion extending in a direction parallel to the longitudinal axis and a second portion extending in a radial direction that is perpendicular to the longitudinal axis;

a protruding portion of the blade retaining member that extends from at least one of a plurality of wall portions of the blade retaining member in the longitudinal axis;

a protrusion disposed on the protruding portion; and a second portion protrusion disposed on the blade retaining member;

wherein the first and second portions of the recess are formed by the plurality of wall portions of the blade retaining member that, along with the second portion protrusion, are configured to removably attach the removably-attachable blade cartridge to a first device;

wherein the protrusion is a second attachment portion configured to removably attach the removably-attachable blade cartridge to a second device; and wherein the second portion protrusion is disposed in the second portion of the recess.

2. The removably-attachable blade cartridge of claim 1, further comprising a blade and a cover member that is removably attachable to the blade retaining member, the blade being attached to the blade retaining member based on being received in a cavity of the cover member when the cover member is removably attached to the blade retaining member.

3. The removably-attachable blade cartridge of claim 2, wherein the blade extends through an aperture of the cavity of the cover member when the blade is received in the cavity of the cover member.

4. The removably-attachable blade cartridge of claim 2, wherein the blade is a ceramic blade.

5. The removably-attachable blade cartridge of claim 1, wherein the second portion extending in the radial direction is a radial recess portion extending perpendicularly to the first portion.

6. The removably-attachable blade cartridge of claim 1, wherein the protruding portion is configured to be received in a cavity of the second cutting device.

7. A cutting system, comprising:

a removably-attachable blade assembly including a blade retaining member that is elongated to define a longitudinal axis, a recess, which is substantially L-shaped, disposed in the blade retaining member, the recess having a first portion extending in a direction parallel to the longitudinal axis and a second portion extending in a radial direction that is perpendicular to the longitudinal axis, a protruding portion of the blade retaining member that extends from at least one of a plurality of wall portions of the blade retaining member in the longitudinal axis, a retaining protrusion disposed on the protruding portion; and a second portion protrusion disposed on the blade retaining member;

wherein the first and second portions of the recess are formed by the plurality of wall portions of the blade retaining member that, along with the second portion protrusion, are configured to removably attach the removably-attachable blade assembly to a first device; and wherein the second portion protrusion is disposed in the second portion of the recess;

wherein the first device includes a first-device protrusion configured to be received in the first and second portions of the recess at different times during the insertion of the removably-attachable blade assembly into a cavity of the first device; and a second device including a cavity formed by a wall including an aperture, the aperture configured to receive the retaining protrusion when the removably-attachable blade assembly is inserted in the cavity of the second device.

8. The cutting system of claim 7, wherein the first-device protrusion moves in the first portion of the recess based on pushing or pulling the protruding portion in the cavity of the first device.

9. The cutting system of claim 7, wherein the first-device protrusion is locked in place in the second portion of the recess based on moving the first-device protrusion over the second portion protrusion disposed in the second portion of the recess.

10. The cutting system of claim 7, wherein the first device has a first configuration that is different from a second configuration of the second device.

* * * * *